United States Patent [19]

Reed et al.

[11] Patent Number: 4,772,780

[45] Date of Patent: Sep. 20, 1988

[54] SLIDE CALCULATOR FOR PHOTOGRAPHIC LIGHTING

[76] Inventors: Muriel A. Reed; Roger G. Reed, both of 6704 Hoover Rd., Indianapolis, Ind. 46260

[21] Appl. No.: 27,606

[22] Filed: Mar. 18, 1987

[51] Int. Cl.[4] ..... G06C 3/00

[52] U.S. Cl. ..... 235/64.7; 235/70 R; 235/70 A

[58] Field of Search ..... 235/64.7, 69, 70 R, 235/70 A

[56] References Cited

U.S. PATENT DOCUMENTS

| | | | |
|---|---|---|---|
| 2,787,419 | 4/1957 | Norwood | 235/64.7 |
| 3,908,112 | 9/1975 | Lo et al. | 235/64.7 X |
| 3,933,305 | 1/1976 | Murphy | 235/70 A |
| 4,189,634 | 2/1980 | LaBove et al. | 235/70 A |
| 4,361,752 | 11/1982 | Holmes | 235/64.7 |

*Primary Examiner*—B. R. Fuller

[57] ABSTRACT

The object of the invention is to provide a slide calculator to make the determination of flash-to-subject working distances (WD) easy and accurate for amateur and professional photographers. Light sources other than flash can be used. The calculator uses known factors such as lens f-stop, film speed, light ratio, flash guide number (GN), flash power setting and filter exposure factors to determine working distances even when using multiple flashes simultaneously. The indicia on the slides and the indicia adjacent the appropriate windows on the panels are arranged in a predetermined manner and relationship to each other to permit the desired working distance to be determined accurately. Working distances for several flashes (each flash having a different purpose) can be determined and their affect on each other is compensated for in the calculations. Then the several flashes can be used in combination to achieve a desired lighting effect with correct exposure.

15 Claims, 6 Drawing Sheets

SLIDE CALCULATOR FOR PHOTOGRAPHIC LIGHTING

BACKGROUND OF THE INVENTION

This invention relates to slide calculators, and more specifically, to a calculator for determining factors relating to lighting as used in photography for correctly exposing film. Since electronic flash is the most popular form of artificial light used in photography, the word flash is used herein to mean any artificial light source. Light is one of many necessary factors involved in photography, annd studio photography requires artificial light. Some of the factors affecting the amount and quality of light striking the film in a camera are lens f-stop, exposure factors of filters over the lens, light-ratio, exposure factors of filters over the flash, size of the flashes, power setting of the flashes, the angle of the main-flash in relation to the camera-subject line and the distance of the flashes from the subject.

STUDIO LIGHTING

Petersen's Photographic Magazine publishes a book titled "Electronic Flash" in which the author, Jim Cornfield, explains a method of establishing light-ratios in the Studio:

> "In order to establish a 3:1 ratio between main and fill, we must now determine the distance from fill-to-subject that will give us fill-in illumination that is one stop less than the main illumination. That means we must find the fill-light-to-subject distance which will require one stop more exposure, or an aperture of f/11.
>
> "As in most multiple lighting setups with any kind of artificial light source, your correct exposure setting should be based on the effect of the main light alone. In the above example, our proper aperture setting would be f/16—the f-number dictated by the main-light-to-subject distance—no matter what lighting ratio we were trying to establish with the fill light."

The above example actually produces a required lens f-stop of f/16+½-stop. If you were to set up the lights for a 2:1 ratio using this method, the lens f-stop derived thereby would actually be one full f-stop incorrect. Notice that the author bases exposure solely on the main-light but, in the following example, the author tells us the opposite.

Smith-Victor Corp., manufacturer of photographic lighting equipment, publishes a booklet titled "A Word About Portrait Lighting." In it the author talks about setting up lights to achieve specific lighting ratios. He states:

> "As to exposure, use a meter, at least to get your basis established. For simplicity and ease you can base your exposure on the Fill-Light alone. Moving the Key light from the same distance to three quarters the distance, to half the distance does not necessarily call for a change in exposure with the Fill at a constant distance."

Notice that this method will produce lighting that will over expose the film by about 2⅓ f-stops, however, later on the same page he states:

> "Make a basic set up of 4 lights—FILL, KEY, BACKGROUND AND BACKLIGHT with the key the same distance from the subject as the fill. Use a meter to get the exposure right on the button."

Here the author makes it clear that he intends to base the exposure on both the fill and the key and both at the same distance. With the lights the same distance and same power, the light-ratio is 2:1. With the key light moved to half the distance, the inverse square law tells us that the light on the subject from the key will be 4 times as great and produce a 5:1 ratio. This method will produce light which will over expose the film by about 1⅓ f-stops. This is more than most slide films will tolerate.

This demonstrates to us that methods for determining Light Ratio and exposure simultaneously are very rule-of-thumbish and inaccurate, even with the aid of a meter. This is typical of all literature on the subject.

Eastman Kodak Co. introduced a Light-Ratio-Calculator to the photographic market in 1980 which they claimed would calculate Working Distances for the Main-Light and Fill-Light for any of three different Light-Ratios, 2:1, 3:1 or 5:1. Tests show that at 2:1 Light-Ratio the subject is overexposed by one f-stop and at 5:1 ratio the subject is overexposed by 2½ f-stops. To use the Slide Chart, it was first necessary to manually calculate the required Working Distance for the Fill-light or determine it with a meter. Once that distance was determined, then a Working Distance for the Main-Light could be determined using the slide chart—but it was incorrect. No provisions were made for the use of filters or power settings for the lights. No provisions were made for calculating the Working Distances of Edge (Rim) Lights either.

Therefore, there is still a need for a calculator which will give correct flash Working Distances for a variety of lighting setups using a variety of lighting equipment such as a Main-Light, Fill-Light, Edge-Lights (also hair lights) on either side of the subject, without requiring separate manual calculations and requiring neither the use of an ordinary meter, nor an expensive electronic flash meter.

It is the object of Side 1 of this invention to make available to photographers, a slide calculator for determining the necessary distance between the flash and the subject which will provide correct exposure of the film, taking into consideration many variables, some of which are:

(a) lens aperture (f-stop)
(b) film speed (ISO rating)
(c) density of filters (Filter exposure factor)
(d) ratio of intensity of light on one area of a subject compared to the intensity of light on another area of said subject (Light-Ratio)
(e) amount of flash power used compared to total available (Power Factor)
(f) relative power of flash (Guide Number or GN).

SUN/FILL-IN LIGHTING

At present, most experts use the same methods to guess at fill-in flash in the sun. "Electronic Flash" published by Petersens Photographic magazine gives a good example of this. The author uses the same method as he does in the studio, however, factors that he does not allow for, makes the ratios and lens f-stops even more inaccurate outdoors.

This method does not compensate for the light that is already on the shaded side of the subject. Light comes from the surrounding sky which could be very bright, depending on the amount of polution and clouds in the sky. Light also comes from surrounding ground and structures which could be very reflective.

For example, if the difference between the sunny side and the shaded side of a subject is only 2 f-stops then, by the above method, the light ratio will actually be 2:1, not 3:1. The only place this method is accurate is in outer space where the sun is not reflecting from surrounding surfaces and atmosphere.

Eastman Kodak publishes a "Professional Guide" in which there is a fill-in flash exposure dial for determining flash distances for sun/fill-in applications. This dial limits the selection of lighting-ratio to a single choice of 3:1. By comparing the results of this dial with the results of the equations shown herein, it is clear that the answers given by the dial are not correct. For example, assuming a GN of 40, a meter reading of f/16 in the sun, an f-stop difference of 5 from a reading in the sun to a reading in the shade, and attempting to achieve a final Light-Ratio of 3:1 with the aid of Fill-in flash, the following comparisons are made:

| Calculator: | Kodak Dial | This Invention |
|---|---|---|
| Sun alone | f/16 | f/16 |
| lens: | f/16 | f/16 + ½ stop |
| distance: | 4.8 feet | 3.7 feet |

To understand the above descrepancy in distance requires close study of the equations, however, the descrepancy in lens f-stop is obvious—If f/16 is the meter reading in the sun, and the lens is set at f/16, it is obvious that adding the Fill-flash to the light already on the subject, will overexpose the film by the amount of light added by the fill-light. In the above example the Fill-Light adds ½ stop. To achieve a 2:1 ratio the Fill-Light will add 1 full stop to the light already on the subject.

One object of Side 2 of this invention is to make available to photographers, a slide calculator for determining the necessary distance between the flash and the subject which will provide correct exposure of the film, while allowing the photographer freedom of choice of final Light-Ratio, taking into consideration many variables, some of which are:

(a) Sun f-stop
(b) the difference from sun f-stop to shade f-stop
(c) Light-Ratio desired
(d) relative capacity of flash (GN).

LIGHT-RATIO FRONT/REAR

There is no know history of such calculations, either manually or by slide calculator.

Another object of Side 2 of this invention is to make available to photographers, a slide calculator for determining the necessary distance between the flash and the subject which will provide correct exposure at the front of the subject, while allowing the photographer freedom of choice of Light-Ratio, from the front of a subject to the back of a subject using a single flash. This takes into consideration many variables, some of which are:

(a) dimension of the subject from front to rear
(b) Light-Ratio desired
(c) relative capacity of flash (GN).

GENERAL

Another object of the invention is to provide a slide calculator which can be inexpensively produced and can be made available at a modest cost.

These and other objects of the invention will become apparent from the following description and appended claims.

SUMMARY OF THE INVENTION

There is provided by this invention a four-piece slide calculator for determining accurate Working Distances for studio lighting situations, for subjects lit by direct sun light and for situations requiring a definite light-ratio from the front of the subject to the back of the subject illuminated by a single flash.

The slide calculator includes an envelope-like structure having a front and back panel which are secured to one another. Each panel has at least one window-like aperture and includes indicia associated with each of said apertures. Three slide members are also provided which are positioned between the front and back panels and are movable therebetween. The slide members also include indicia thereon arranged to appear at preselected apertures and to cooperate with indicia on the front or back panels in order to permit the desired calculation.

For example, in determining the Working Distance for the Main-Light, the front panel includes two apertures with indicia relating to Lens f-stop associated with one aperture, and indicia relating to an Angle $\theta$ associated with the other aperture where $\theta$ is the angle between a line drawn from the Camera to the Subject and a line drawn from the Main-Light to the Subject.

Beginning at the top, the first movable slide includes indicia relating to Film speed arranged to cooperate and permit alignment with the Lens f-stop indicia on the front panel. The opposite edge of said movable slide member includes indicia relating to Exposure Factors related to the Lens.

The second movable slide includes indicia relating to Light-Ratios arranged to cooperate and permit alignment with the Exposure Factor indicia associated with the first movable member. The opposite edge of the second movable member includes indicia relating to Exposure Factors related to the Main-Light.

The third movable slide member includes indicia relating to Working Distsnce arranged to cooperate and permit alignment with the Exposure Factor indicia relating to flashes associated with the second movable member. The opposite edge of the third movable member includes indicia relating to Flash GN which are inscribed upon the slide member by the user of the slide calculator, and are arranged to cooperate and permit alignment with the Main-Light Angle indicia associated with the aperture in the front panel.

By omitting the GN scales relating to the Fill-Edge-Light, Fill-Light, Main-Light and Main-Edge-Light then instructing the User of the Calculator to inscribe indexes on the bottom slide member and adjacent panel surface in a position relating to the Users own lighting equipment, it is possible to include indicia for all four (4) of said lights in one, easy to read, slide calculator. Even if two or more of the lights are the same GN, the indexes can be spaced far enough apart to allow bold labeling of each index which permits reading in low light levels.

Other apertures and indicia are provided on the back panel and slide members for determining accurate Working Distance when making photographs in direct sun light while controlling the Light-Ratio on the Subject.

Other apertures and indicia are provided on the back panel and slide members for determining the Working Distance necessary for one flash to produce a specific ratio between the amount of light falling on the Subject's front compared to the amount of light falling on the Subject's rear.

BRIEF DESCRIPTION OF THE DRAWINGS

FIG. 2 is a plan view of the front panel;

DESCRIPTION OF THE PREFERRED EMBODIMENT

Definitions

Figure 1:
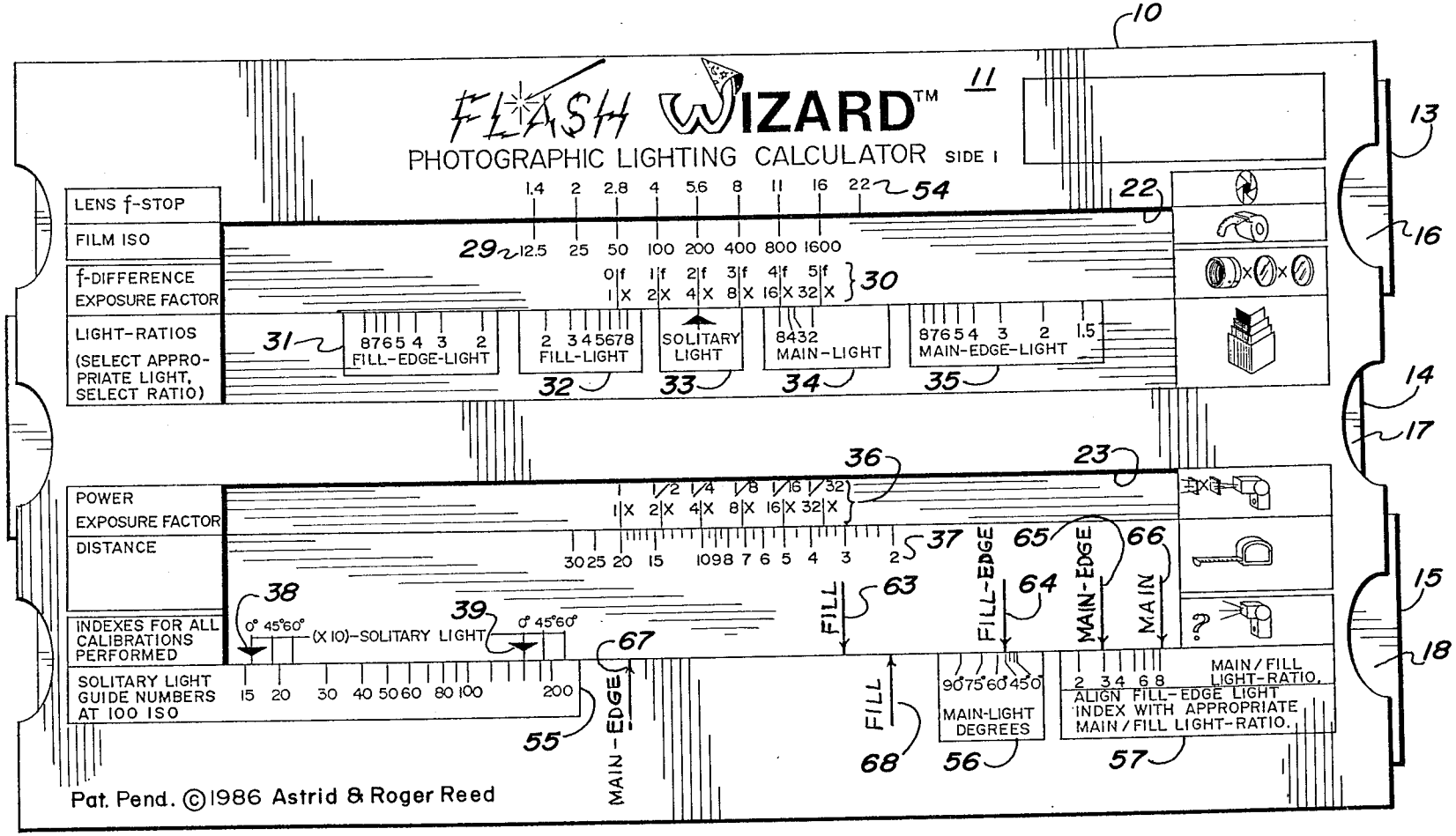
FIG. 1 is a plan view of the front panel with the slide members in position.

Fill-Light: a light positioned as close to the camera-subject line as practical without interfering with the camera, thus illuminating the entire subject: also referred to as a Fill-In-Light in some literature.

Fill-Side: the side of the subject which receives Fill-Light, but does not receive any Main-Light.

Fill-Edge-Light (or Fill-Hair-Light), referred to hereinafter as Fill-Edge-Light; a light positioned behind and to the side of the subject (about 135 degrees) so that it illuminates only the Fill-Edge of the subject, combining with the Fill-Light; also referred to as Rim-Light in some literature. The GN of this light is established with the light operating at the angle at which it is to be used, therefore, no Cosine correction is necessary.

Fill-Edge: the edge of the subject which receives light from both the Fill-Light and the Fill-Edge-Light.

Main-Light: a light which is most commonly positioned at about 45 degrees from the Camera-Subject line but can actually vary from about zero degrees to about 90 degrees depending on the effect desired. It illuminates the Main-Side in combination with the Fill-Light. The Main-Light is also referred to as a Key-Light in some literature.

Main-Side: the side of the subject which receives light from both the Fill-Light and the Main-Light.

Main-Edge-Light or Main-Hair-Light (referred to hereafter as Main-Edge-Light): a light positioned behind and to the side of the subject (about 135 degrees) so that it illuminates only the Main-Edge of the subject; also referred to as Rim-Light in some literature. The GN of this light is established with the light operating at the angle at which it is to be used, therefore no Cosine correction is necessary.

Main-Edge: the edge of the subject which receives light from the Fill-Light, Main-Light and the Main-Edge-Light.

$D_{SUBJ}$=Depth of Subject: the distance from the Subject Front to the Subject Rear.

EF=Exposure Factor of a light modifying device. Rating is based on a change in the magnitude of the amount of light required (not based on number of f-stops added). This rating is used to compensate for lens filters. Use 1× Exposure Factor for no filter. To find the correct Exposure Factor, multiply the Exposure Factor of each of the filters on the lens times each other. Example: You have three lens modifiers involved for a particular photograph you want to make;

2× for a lens extension 1.4× for a lens filter 1.4× for another lens filter

Correct Exposure Factor==2×1.4×1.4=3.9 (Round off to 4×)

f-difference=a rating of lens filters: Required number of f-stops to increase the lens aperture when using said filter.

$f_L$=Lens f-stop setting.

$f_{SHADE}$=Shade f-stop: f-stop meter reading of a gray card shaded from the sun.

$f_{SUN}$=Sun f-stop: f-stop meter reading of a gray card in full sun light.

GN=Guide Number: a rating for a flash expressed in ISO-feet or ISO-meters. Wherein, $GN_{FEL}$=Guide Number for Fill-Edge-Light.

$GN_{FL}$=Guide Number for Fill-Light.

$GN_{SL}$=Guide Number for Solitary-Light.

$GN_{ML}$=Guide Number for Main-Light.

$GN_{MEL}$=Guide Number for Main-Edge-Light.

$GN_{SF}$=Guide Number for Sun/Fill-In-Light.

$GN_{Rfr}$=Guide Number for Light-Ratio Front/Rear Light.

$ISO_{FILM}$=ISO rating of photographic film.

$ISO_{GN}$=ISO rating upon which the GN of a flash is based.

$\theta$=an angle between a line drawn from the camera to the subject and a line drawn from the subject to the light.

Power=a fraction of the full capacity of a light.

R=Light-Ratio: a ratio equal to the brightness of light on the Main-Side of a subject divided by the brightness of light on the Fill-Side of a subject. It is a ratio of two different intensities of light. It is not a ratio of two different f-stops.

Rfe=Light Ratio: Fill-Edge compared to the Fill-Side.

Rfr=Front-to-Rear Light-Ratio: The light striking the surface of the subject nearest the Flash (front of Subject) divided by the light striking the surface of the Subject farthest from the Flash (rear of Subject)

Rme=Light Ratio: Main-Edge compared to the Main-Side.

WD=Working Distance: the distance between the light and the subject being photographed which gives correct film exposure. Wherein, $WD_{FEL}$=Working Distance for Fill-Edge-Light.

$WD_{FL}$=Working Distance for Fill-Light.

$WD_{SL}$=Working Distance for Solitary-lIght.

$WD_{ML}$=Working Distance for Main-Light.

$WD_{MEL}$=Working Distance for Main-Edge-Light.

$WD_{SF}$=Working Distance for Sun/Fill-In-light.

$WD_{Rfr}$=Working Distance for Light-Ratio Front-/Rear Light.

General

Referring now to the drawings, there is shown a four-piece slide calculator 10 generally. The calculator includes a front panel 11 (see FIG. 1 and FIG. 3) and a back panel 12 (see FIG. 2 and FIG. 5) which are fastened together at the corners to form an envelope-like structure. Three slide members 13, 14 and 15 (see FIG. 4 and FIG. 6) are provided and are positioned between the front panel and back panel for longitudinal movement therebetween, independent of each other (see FIG. 1 and FIG. 2).

The three slide members 13, 14, and 15 include front and back faces 16, 17, 18, 19, 20 and 21 for cooperation with the front and back panels 11 and 12, respectively.

The front panel 11 in cooperation with the three front faces 16, 17 and 18 are used to determine the Working Distance (WD) for five (5) different types of photographic studio lights including Fill-Edge-light, Fill-Light, Solitary-Light, Main-Light and Main-Edge-Light.

The back panel 12 and three back faces 19, 20 and 21 cooperate with each other to determine the Working Distance and Lens f-stop for Sun/Fill-in flash photographs and to determine the Working Distance and Flash Power for controlling Front/Rear Light-Ratio.

Side One of Calculator

Panel

Figure 3:
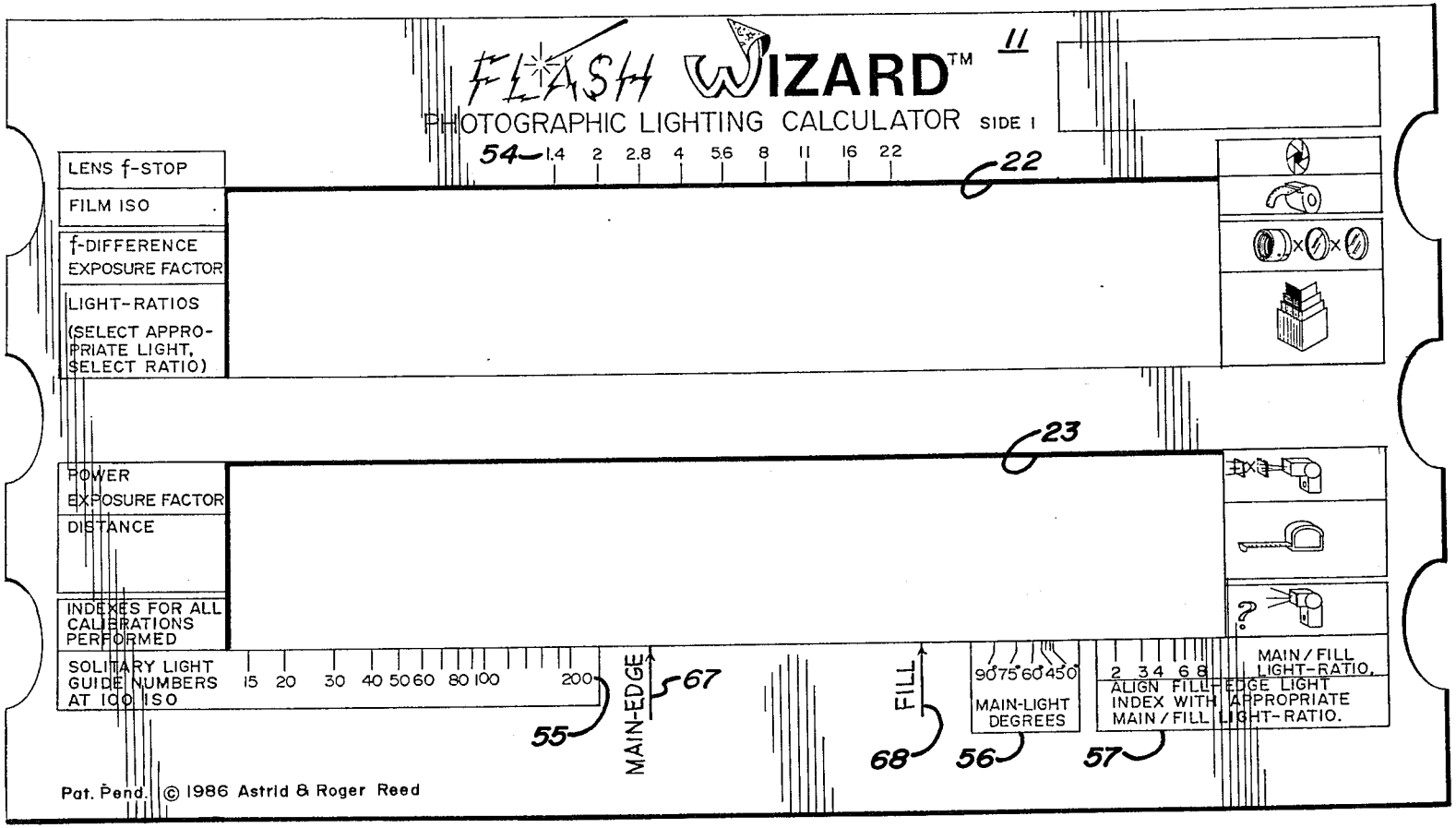

Referring now to FIGS. 1 and 3, the front panel 11 includes an upper exposing window 22 which has a label "Lens f-stop" identifying scale 54 ranging from f/1.4 to f/22 appearing above the window and four (4) labels, "Film ISO," "f Difference," "Exposure Factor" and "Light-Ratios" identifying the scales 29 ranging from 12.5 to 1600, 30 ranging from 0f to 5f and from 1× to 32× respectively, 31 ranging from 2 to 8, 32 ranging from 2 to 8, 33 a single index, 34 ranging from 2 to 8, and 35 ranging from 1.5 to 8; all viewed through the window.

The lower exposing window has five (5) labels, "Power," "Exposure Factor," "Distance," and "Indexes for all Calibrations Performed" identifying the scales 36 ranging from 1 to 1/32 and from 1× to 32× respectively, 37 ranging from 2 to 39, 38 angle scale representing a multiple of ten, 39 a second angle scale, 63 a single index, 64 a single index, 65 a single index and 66 a single index; all viewed through the window. The lower exposing window also has three (3) labels. "Solitary-Light Guide Numbers at 100 ISO," "Main-Light" and "Main/Fill Light-Ratio" identifying the scales 55 ranging from 15 to 200, 67 a single index representing the Main-Edge-Light GN, 68 a single index representing the Fill-Light GN, 56 ranging from 0 degrees to 90 degrees and 57 ranging from 2 to 8, all appearing below the window.

Slide Members

Figure 4:
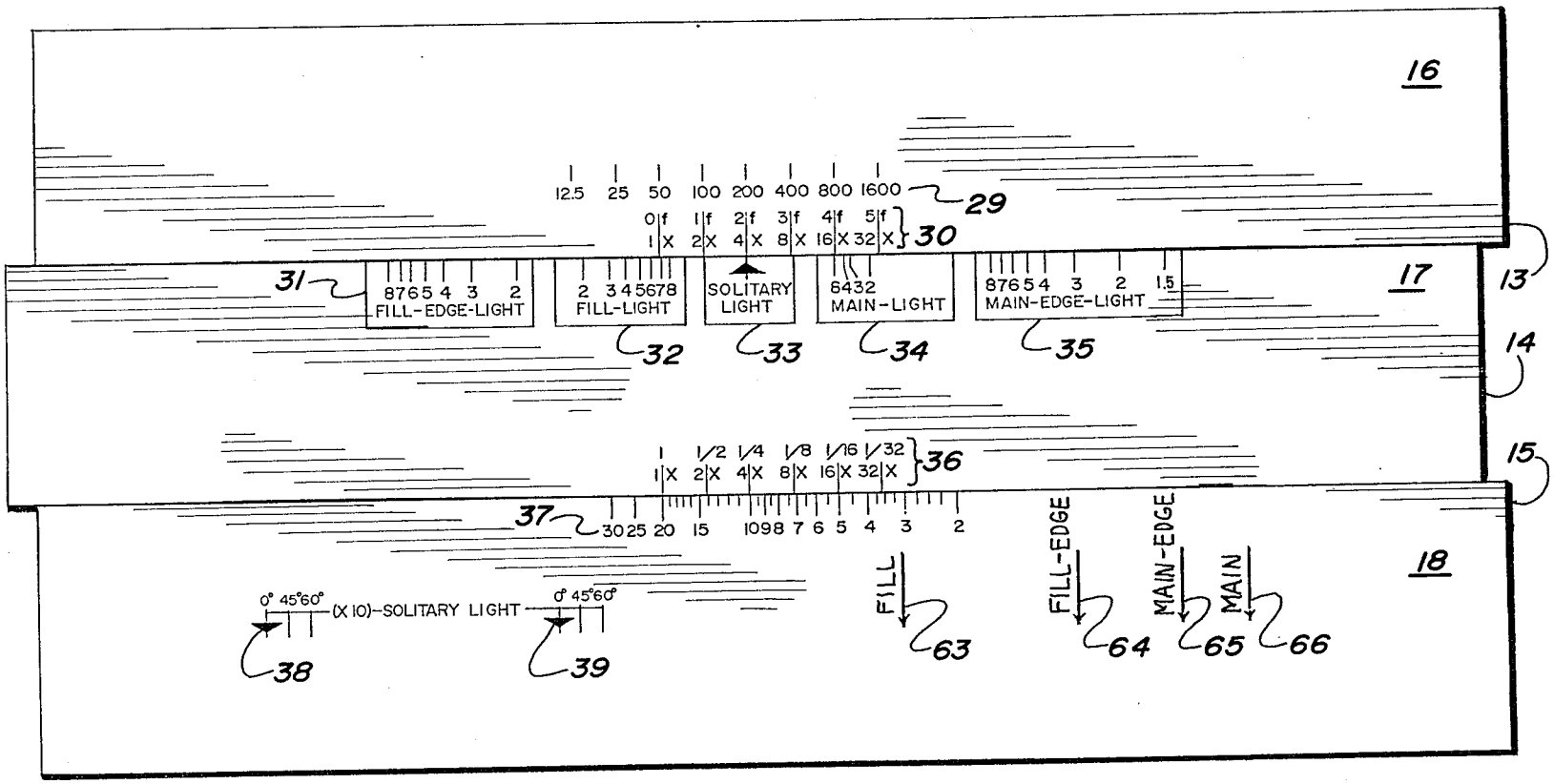
FIG. 4 is a plan view of the front side of the slide members which cooperate with the front panel member.

Referring now to FIG. 1 and FIG. 4, side one 16 of the top slide member 13 hs a Film ISO scale 29 ranging from 12.5 to 1600 which is arranged to work in cooperation and permit alignment with the Lens f-stop scale 54 positioned on the panel face 11. This slide member also has an f-difference and an Exposure Factor scale 30 ranging from 0f to 5f and from 1× to 32× respectively, both arranged to work in cooperation and permit alignment with all of the Light-Ratio scales located on the face 17 of the middle slide member 14. If Lens Filters and Extension Tubes are rated in f-difference then read the f-difference part of scale 30. If Lens Filters and Extension Tubes are rated in Exposure Factors then read the Exposure Factor part of scale 30. If multiple Lens Filters and Extension Tubes are used then convert all the f-difference ratings to Exposure factor ratings by reading the number directly below on scale 30 and use the product of all of the Exposure Factors to align with the Light-Ratios and Solitary-Light Index on scales 31, 32, 33, 34 and 35.

Side one 17 of the middle slide member 14 has four Light-Ratio scales, "Fill-Edge-Light" 31, "Fill-Light" 32, "Main-Light" 34 and "Main-Edge-Light" 35 each ranging from 1 to 8 plus a single index for a "Solitary-Light" 33; all positioned on the top edge of the slide member and arranged to work in cooperation and permit alignment with the f-difference and Exposure Factor scales 30 located on the lower edge of the face 16 of slide member 13. The bottom edge of the middle slide member has two scales, "Power" and "Exposure Factor" 36 arranged to work in cooperation and permit alignment with the distance (WD) scales 37 located on the top edge of the face 18 of bottom slide member 15. If computing with fractions of power, then use the power portion of scale 36. If computing with Exposure Factor, then use the Exposure Factor portion of scale 36. If computing with a combination of power reduction and filter Exposure Factors then convert the Power to Exposure Factor by reading the Exposure Factor directly below the Power and then reading the distance (WD) on scale 37 in alignment with the product of the two Exposure Factors on scale 36.

Side one 18 of the bottom slide member 15 has a distance (WD) scale 37 ranging from 2 to 30 arranged to work in cooperation and permit alignment with the "Power" and "Exposure Factor" scales 36 located on the lower edge of the face 17 of the middle slide member 14. The lower portion of the bottom slide member has indicia for two Solitary-Light angle scales "Solitary-Light×10" 38 and "Solitary-Light" 39, as well as four other single indexes, "Fill-Light" 63, "Fill-Edge-Light" 64 , "Main-Edge-Light" 65 and "Main-Light" 66, each arranged to work in cooperation and permit alignment with their respective scales located on the bottom edge of the bottom window in the front panel 11. Indexes 63, 64, 65 and 66 are inscribed by the user of the calculator, the position of which is determined by their respective flash GN's.

Set of Conditions and Example Calculations

A set of conditions is assumed for purposes of illustrating the example calculations performed by the front side of the calculator. The conditions are:

| | |
|---|---|
| Lens f-stop = | f/5.6 |
| Film speed = | 200 ISO |
| Lens Exposure Factor (total) = | 1X (no filters) |
| (also f-difference) | (also 0 f) |
| Light-Ratio (Fill-Edge/Fill-Side) = | 4:1 |
| Light-Ratio (Main-Side/Fill-Side) = | 3:1 |
| Light-Ratio (Main-Edge/Main-Side) = | 2:1 |
| Main-Light angle $\theta$ = | 45 degrees |
| Solitary-Light angle $\theta$ = | 0 degrees |
| Solitary-Light GN @100 ISO = | 40 |

Fill-Edge Light

The following equation is solved to determine the Working Distance for the Fill-Edge-Light where EF=Total Exposure Factor of light modifying devices on Fill-Edge-Light and Camera lens:

$$WD_{FEL} = \frac{GN_{FEL} * [(ISO_{FILM})/(ISO_{GN} * EF)]^{(0.5)}}{\{[0.5^{[log(R/e)/log(0.5)]} - 1] * f_L^2 * 0.5^{[log(R)/log(2)]}\}^{(0.5)}}$$

Referring to FIG. 1, the Working Distance for the Fill-Edge-Light is determined by moving slide member 13 until 200 ISO Film Speed on scale 29 is aligned with 5.6 Lens f-stop on scale 54 then moving slide member 14 until a Light-Ratio of 4 on the Fill-Edge-Light scale 31 is aligned with 1× Exposure Factor (and 0f-difference) on scale 30; then moving slide member 15 until the Fill-Edge-Light Index 64 is aligned with the Light-Ratio of 3 on the Fill-Edge-Light scale 57; then reading about 7 on the distance (WD) scale 37 opposite 1 Power on scale 36. Here, and for all other examples herein, the unit of the distance will be the same unit of distance used to determine the Guide Numbers (GN).

Fill-Light

The following equation is solved to determine the Working Distance for the Fill-Light where EF=Total Exposure Factor of light modifying devices on Fill-Light and Camera lens:

$$WD_{FL} = \frac{GN_{FL} * [(ISO_{FILM})/(ISO_{GN} * EF)]^{(0.5)}}{[f_L^2/R]^{(0.5)}}$$

Referring to FIG. 1, the Working Distance for the Fill-Light is determined by moving slide member 13 until 200 ISO Film Speed on scale 29 is aligned with 5.6 Lens f-stop on scale 54 then moving slide member 14 until the Light-Ratio of 3 on the Fill-Light scale 32 is aligned with 1× Exposure Factor (and 0f-difference) on scale 30; then moving slide member 15 until the Fill-Light Index 63 is aligned with the Fill-Light Index 68; then reading about 8.5 on the distance (WD) scale 37 opposite ¼ Power on scale 36.

Solitary-Light

The following equation is solved to determine the Working Distance for a Solitary-Light where EF=Total Exposure Factor of light modifying devices on Solitary-Light and Camera lens and $\theta$=Angle between Camera-Subject line and Light-Subject line:

$$WD_{SL} = \frac{GN_{SL} * (\cos\theta)^{(0.5)} * [(ISO_{FILM})/(ISO_{GN} * EF)]^{(0.5)}}{f_L}$$

Referring to FIG. 1, the Working Distance for a Solitary-Light is determined by moving slide member 13 until 200 ISO Film Speed on scale 29 is aligned with 5.6 Lens f-stop on scale 54; then moving slide member 14 until the Solitary-Light Index 33 is aligned with 1× Exposure Factor (and 0f-difference) on scale 30; then moving slide member 15 until the 0 degree index of the Solitary-Light angle scale 39 is aligned with 40 GN on the Guide Number scale 55; then reading about 6.7 on the distance (WD) scale 37 opposite ½ Power on scale 36.

Main-Light

The following equation is solved to determine the Working Distance for the Main-Light where EF=Total Exposure Factor of light modifying devices on Fill-Light and Camera lens and $\theta$=Angle between the Camera-Subject line and the Main-Light-Subject line. For cosine correction, $\theta/2$ is used in lieu of $\theta$ because the Main-Light is a large light source (not a point source that the cosine law is based on):

$$WD_{ML} = \frac{GN_{SL} * (\cos(\theta/2)^{(0.5)} * [(ISO_{FILM})/(ISO_{GN} * EF)]^{(0.5)}}{\{f_L^2/[1 + (1/(R-1))]\}^{(0.5)}}$$

Referring to FIG. 1, the Working Distance for the Main-Light is determined by moving slide member 13 until 200 ISO Film Speed on scale 29 is aligned with 5.6 Lens f-stop on scale 54; then moving slide member 14 until a Light-Ratio of 3 on the Main-Light scale 34 is aligned with 1× Exposure Factor (and 0f-difference) on scale 30; then moving slide member 15 until the Main-Light Index 66 is aligned with the Main-Light 45 degree index on the Main-Light degrees scale 56; then reading about 14 on the Distance (WD) scale 37 opposite 2× Exposure Factor on scale 36.

Main-Edge-Light

The following equation is solved to determine the Working Distance for the Main-Edge-Light where EF=Total Exposure Factor of light modifying devices on Main-Edge-Light and Camera lens:

$$WD_{MEL} = \frac{GN_{MEL} * [(ISO_{FILM})/(ISO_{GN} * EF)]^{(0.5)}}{\{[f_L^2/2^{[log(Rme)/log(0.5)]} - f_L^2\}^{(0.5)}}$$

Referring to FIG. 1, the Working Distance for the Main-Edge-Light is determined by moving slide member 13 until 200 ISO Film Speed on scale 29 is aligned with the 5.6 Lens f-stop on scale 54; then moving slide member 14 until a Light-Ratio of 2 on the Main-Edge Light scale 35 is aligned with 1× Exposure Factor (and 0f-difference) on scale 30; then moving slide member 15 until the Main-Edge-Light Index 65 is aligned with he Main-Edge-Light Index 67; then reading about 7 on the distance (WD) scale 37 opposite 2× Exposure Factor on scale 36.

SIDE TWO OF CALCULATOR

Sun/Fill-In Flash

Panel

Figure 2:
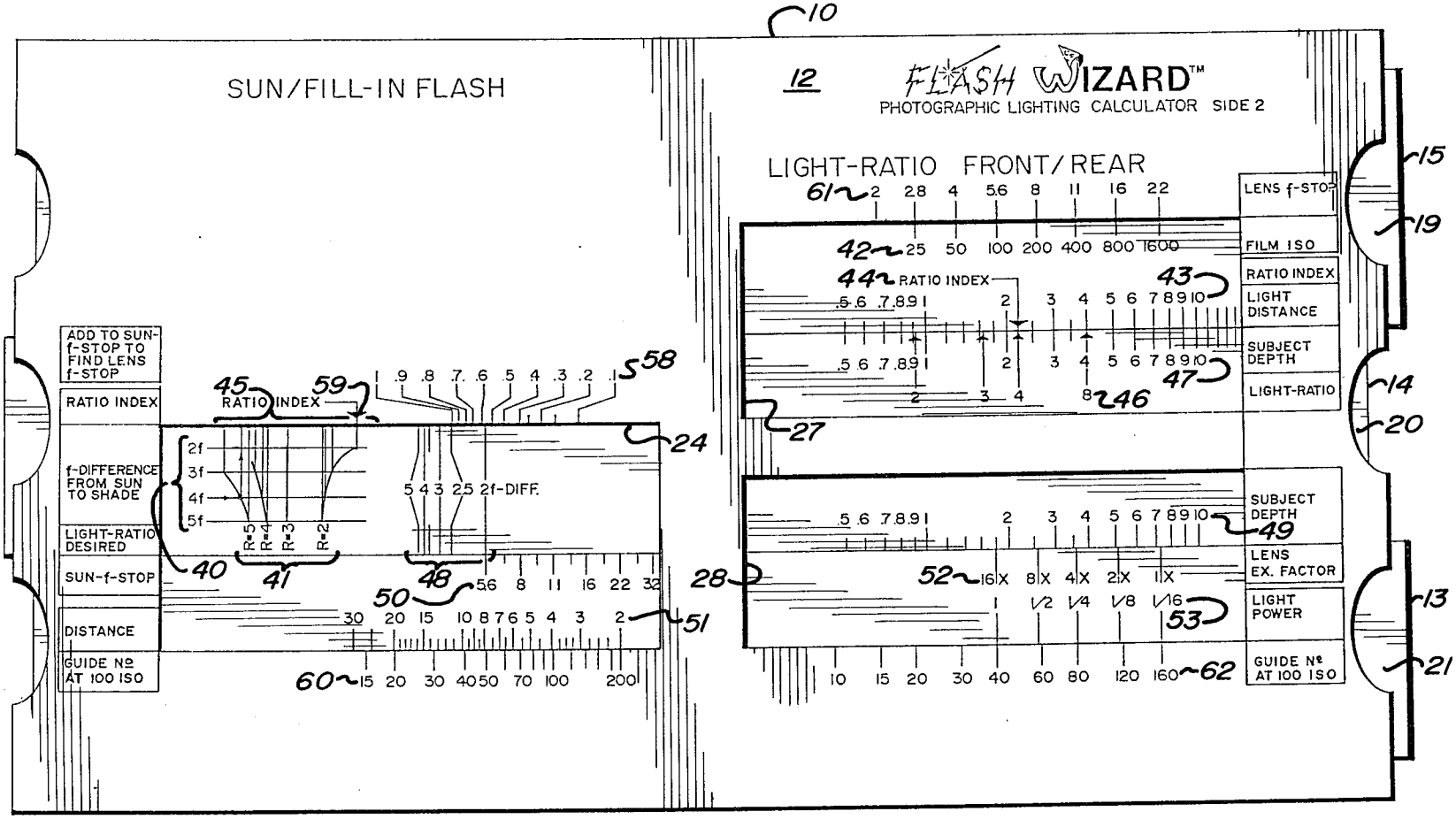
FIG. 2 is a plan view of the back panel with the slide members in position.
Figure 5:
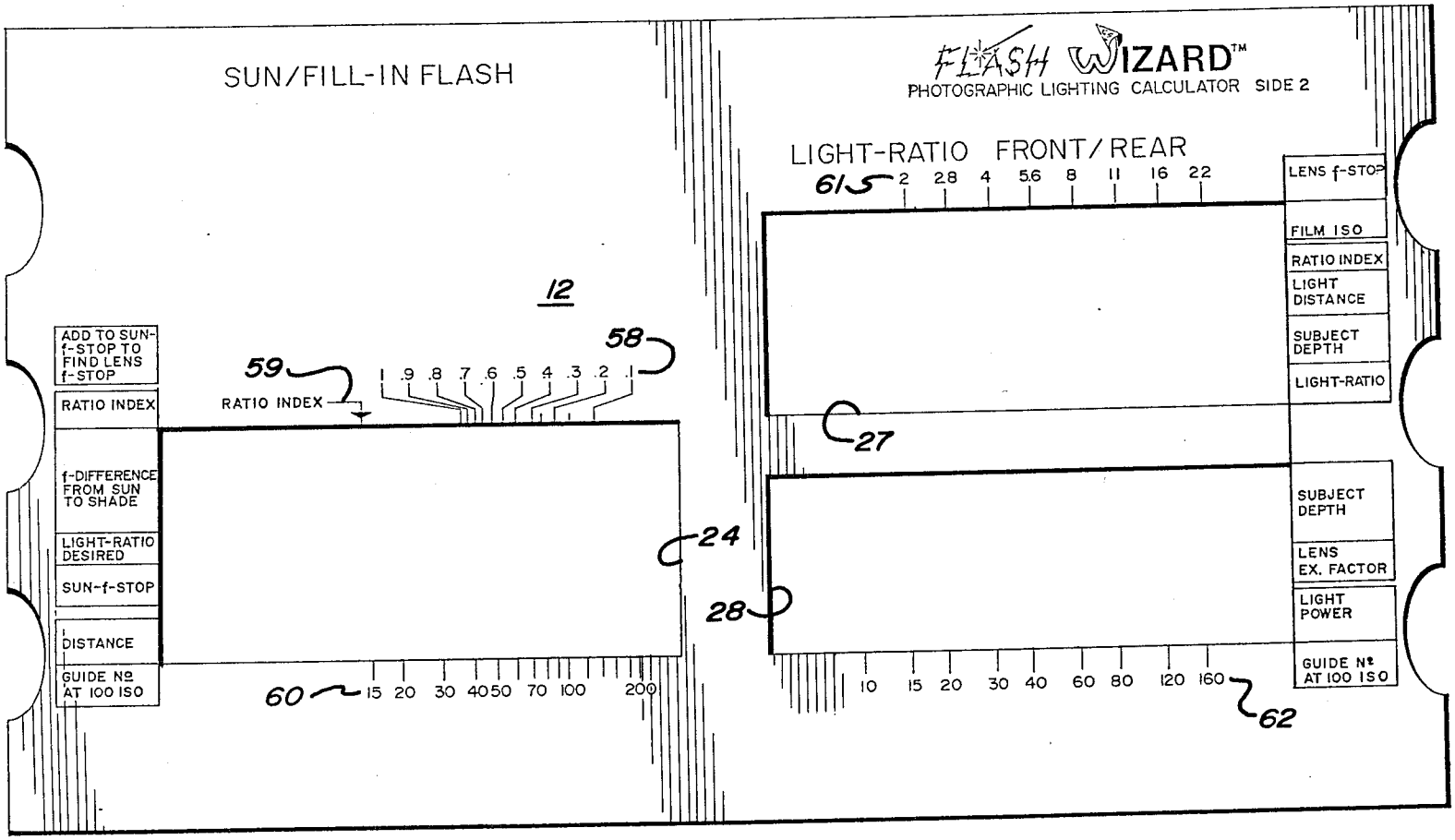
FIG. 5 is a plan view of the back panel.

Referring now to FIGS. 2 and 5, the back panel 12 includes one exposing window 24 which has a label "Add to Sun f-stop to Get Lens f-stop" identifying scale 58 ranging from 0 to 1 appearing above the window and a label "Ratio Index identifying Index 59 appearing above the window. The panel has two labels, "f-difference from Sun to Shade" and "Light-Ratio Desired," identifying scales 40 and 48 both ranging from 1 to 5 and 41 ranging from 2 to 5, all three located on the middle slide member and all three viewed through the window; and two additional labels "Sun f-stop" and "Distance" identifies two scales 50 ranging from 5.6 to 45 and 51 ranging from 2 to 30, both located on the bottom slide member and both viewed through the window.

A label "Flash Guide No. at 100 ISO" identifies scale 60 ranging from 15 to 200 on the panel at the bottom edge of the window.

Slide Members

Figure 6:
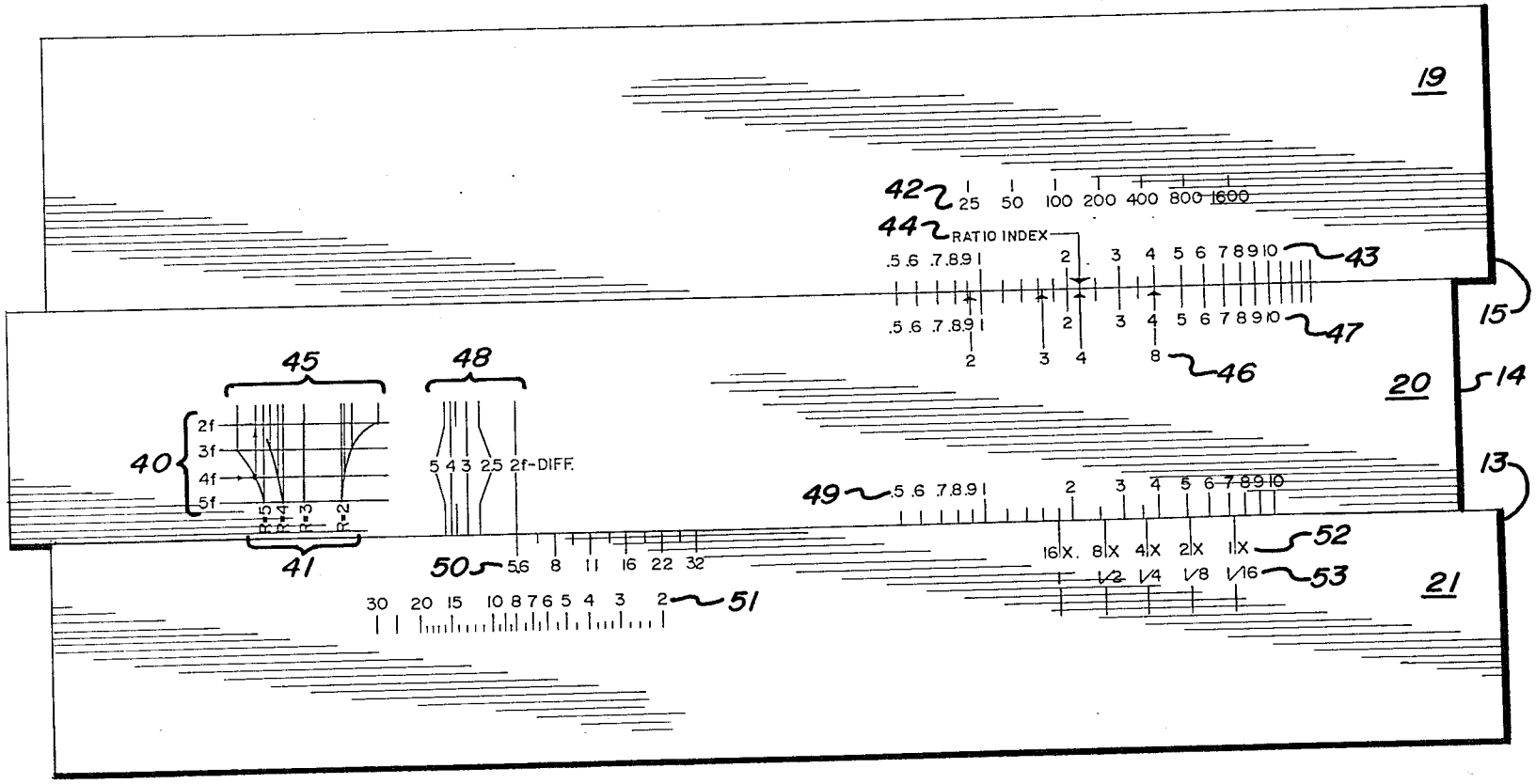
FIG. 6 is a plan view of the back side of the slide members which cooperate with the back panel member.

Referring now to FIG. 2 and FIG. 6, side two 20 of the middle slide member 14 has an "f-diff" scale 40 comprised of horizontal lines ranging from 2 to 5 which is arranged to work in cooperation and permit alignment with the "Light-Ratio Desired" scale 41 comprised of curved lines ranging from 2 to 5. The points whereat the f-Diff lines intersect a Light-Ratio curve determine a family of vertical lines 45 which are arranged to work in cooperation and permit alignment with the Ratio Index 59.

The middle slide member 14 also has a second "f-diff" scale 48 ranging from 2 to 5 which is arranged to work in cooperation and permit alignment with the "Add to Sun-f-stop to get Lens f-stop" scale 58 located at the upper edge of exposing window 24, and work in cooperation and permit alignment with the "Sun f-stop" scale located on the bottom slide member.

Side two 21 of the bottom slide member 13 has a "Sun f-stop" scale 50 ranging from 5.6 to 45 which is arranged to work in cooperation and permit alignment with the second "f-diff" scale 48 on the middle slide member. The bottom edge of this slide member has a "Distance" scale 51 ranging from 2 to 30 which is arranged to work in cooperation and permit alignment with scale 60 located on panel 12 at the bottom edge of window 24.

SET OF CONDITIONS AND EXAMPLE CALCULATIONS

A set of conditions is assumed for purposes of illustrating the example calculations performed by the Sun/-Fill-In portion of the back side of the calculator. The conditions are:

Sun f-stop=f/16
Film speed=100 ISO
f-stops (sun to shade)=4f-stops
Light-Ratio desired=3:1
Flash Guide No.=40 GN.

The following equation is solved to determine the aperture of the Camera Lens ($f_L$) for Sun/Fill-In Flash photography where R=The sum of the direct Sun-Light, Sky-Light and Fill-in-Flash divided by to the sum of the Sky-Light and the Fill-In Flash and $f_{SUN}$=f-stop indicated by a Photo Meter when reading direct sun-light (direct sun plus sky radiation) reflected from a photographic gray card (18% reflectance) and $f_{SHADE}$=f-stop indicated by a Photo Meter when reading sky radiation only (shade) reflected from a photographic gray card:

$$f_L=\{[(f_{SUN2}-f_{SHADE2})/(R-1)]-(f_{SHADE})^2+f_{SUN2}\}^{(0.5)}$$

Referring to FIG. 2, the Lens f-stop is determined by following the 4f-diff line 40 horizontally until intersecting the R3 Light-Ratio curve on scale 41; then determining which vertical line also intersects R3 at the same point; then moving the middle slide member until said vertical line aligns with the Index 59; then reading about +0.46 of an f-stop on scale 58 in alignment with 4f-diff on scale 48; then adding said 0.46 f-stop to the sun f-stop to arrive at the lens f-stop.

The following equation is solved to determine the Flash to-Subject Distance (WD) for the Sun/Fill-In Flash where R=The sum of the direct Sun-Light, Sky-Light and Fill-in-Flash divided by the sum of the Sky-Light and the Fill-In-Flash and $f_{SUN}$=f-stop indicated by a Photo Meter when reading direct sun-light (direct sun plus sky radiation) reflected from a photographic gray card (18% reflectance) and $f_{SHADE}$=f-stop indicated by a Photo Meter when reading sky radiation only (shade) reflected from a photographic gray card:

$$WD_{SF}=\frac{GN_{SF}*[(ISO_{FILM})/(ISO_{GN})]^{(0.5)}}{\{[(f^2_{SUN}-f^2_{SHADE})/(R-1)]-(f_{SHADE})^2\}^{(0.5)}}$$

The sun fill-in flash distance is determined by holding the middle slide member whereat the lens calculation left it, then moving slide member 13 until a "sun f-stop" of f/16 on scale 50 aligns with said f-difference of 4 on scale 48, then reading a distance of about 3.9 on scale 51 in alignment with 40 GN on scale 60.

LIGHT-RATIO FRONT/REAR

Panel

Referring now to FIGS. 2 and 5, the back panel 12 includes an upper exposing window 27 which has a label "Lens f-stop" identifying scale 61 ranging from 2 to 22 appearing above the window. Five (5) other labels, "Film ISO," "Ratio Index," "Flash Distance," "Subject Depth" and "Light-Ratios" identify the scales 42 ranging from 25 to 1600, 44 a single index, 43 ranging from 0.5 to 10, and 47 ranging from 0.5 to 10 and 46 ranging from R2 to R8; all viewed through the window 27.

The back panel 12 also includes a lower exposing window 28 which has three (3) labels "Subject Depth," "Lens Exposure Factor," "Power" identifying scale 49 ranging from 0.5 to 10, scale 52 ranging from 1× to 16×, scale 53 ranging from 1 to 1/16 Power; all viewed through the window 28. The lower exposing window 28 also has a label "Flash Guide No. at 100 ISO" identifyng scale 62 ranging from 10 to 160 located on the panel along the bottom edge of the window 28.

Slide members

Referring now to FIG. 2 and FIG. 6 side two 19 of the top slide member 15 has a "Film ISO" scale 42 ranging from 25 to 1600 which is arranged to work in cooperation and permit alignment with the "Lens f-stop" scale 61 located at the upper edge of exposing window 27. The lower portion of the top slide member has a single index for "Light-Ratios 44, and indicia for "Flash Distance" scale 43 ranging from 0.5 to 10.

Side two 20 of the middle slide member 14 has a Subject Depth scale 47 ranging from 0.5 to 10 which is arranged to work in cooperation and permit alignment with the Flash Distance scale 43 located on the lower edge of the top slide member, and a Light-Ratio scale 46 ranging from R2 to R8 which is arranged to work in cooperation and permit alignment with the "R-Index" located on the top slide member 19; and a second Subject Depth scale 49 ranging from 0.5 to 10 located on the lower edge of the slide member 14.

Side two 21 of the lower slide member 13 has a "Lens Exposure Factor" scale 52 ranging from 1× to 16× which is arranged to work in cooperation and permit alignment with scale 49 on the middle slide member; a "Power" scale 53 ranging from 1 to 1/16 which is arranged to work in cooperation and permit alignment with scale 62 located on the bottom edge of the bottom window 28.

SET OF CONDITIONS AND EXAMPLE CALCULATIONS

A set of conditions is assumed for purposes of illustrating the example calculations performed by the "Light-Ratio Front/Rear" portion of the back side of the calculator. The conditions are:

Lens f-stop=f/5.6
Film speed=100 ISO
Light-Ratio desired=3:1 (Front/Rear)
Depth of Subject=8.0
Lens Exposure Factor=2×
Flash, relative strength=120 GN (Guide Number).

The following equation is solved to determine the Flash-to-Front-of-Subject Distance:

$$WD_{RFr} = \frac{D_{SUBJ}}{Rfr^{(0.5)} - 1}$$

The Flash Distance is determined by moving the top slide member 15 until a "Film ISO" of 100 on scale 42 is aligned with "Lens f-stop" of f/5.6 on scale 61; then moving the middle slide member 14 until the "Light-Ratio" of R3 on scale 46 is aligned with the R-index 44 on the top slide member; then reading a distance of about 11 on scale 43 directly opposite a Subject Depth of 8 on scale 47.

The following equation is solved to determine the Power setting of the Flash to be used where EF=Total Exposure Factor of light modifying devices on Flash and Camera lens:

$$\text{Power} = \frac{D^2_{SUBJ} * f_L{}^2 * EF}{GN^2_{RFr} * [(\text{ISO}_{FILM})/(\text{ISO}_{GN})] * (Rfr^{(0.5)} - 1)^2}$$

The Flash Power required is determined by moving the bottom slide member 13 until a Exposure Factor of 2× on scale 52 is aligned with 8 on scale 49 on the middle slide member then reading ½ Power on scale 53 directly opposite GN of 120 on scale 62.

From the foregoing, it is seen that a simple four-piece calculator is provided for accurately determining the working distances of each of five different photographic studio lights which will give correct exposure of photographic film even when two or more of said lights are operating simultaneously and where the different combinations, that can be calculated, include:

a solitary light;
a main-light plus a fill-light;
said main-light plus said fill-light plus a fill-edge-light;
said main-light plus said fill-light plus a main-edge-light and
said main-light plus said fill-light plus said fill-edge-light plus said main-edge-light.

There is also provided, a means for calculating the Working Distance and Lens f-stop for Sun/Fill-in flash photographs and a means for calculating the Working Distance and Flash Power Factor for controlling Front/Rear Light-Ratio. All of the above calculations are made possible in an inexpensive, quick and accurate manner.

It will also be appreciated that modifications can be made to the embodiment shown herein without departing from the spirit and scope of this invention. Such modifications include, but are not limited to, changing from a linear scale design to a circular scale design, changing the physical size and changing the upper and lower limits of one or more scales.

We claim:

1. A slide calculator for providing accurately correct exposure of a subject and accurate user selectable (a) main-light and fill-light light-ratio,
(b) fill-edge-light light-ratio,
(c) main-edge-light light-ratio,
(d) hair-light (on fill-side) light-ratio and
(e) hair-light (on main-side) light-ratio for said subject based on user selectable factors (a) camera lens f-stop,
(b) film ISO,
(c) camera lens filter exposure factor,
(d) light power factor,
(e) guide number of light and
(f) angle of main-light by calculating the correct working distances for a plurality of different simultaneously operating photographic studio lights of a selected power comprising;

a panel member having two window-like apertures and first, second and third sliding members, said sliding members being cooperatively associated with each other and said panel member, and movable with respect to said panel member;

a first set of cooperating scales positioned on adjacent portions of said panel member and said first sliding member, a first scale of said first set being on said panel member and having spaced apart indica representative of said camera lens f-stop ($f_L$), a second scale of said first set being on said first sliding member and having spaced apart indicia representative of said film ISO ($ISO_{FILM}$);

a second set of cooperating scales and an index positioned on adjacent portions of said first sliding member and said second sliding member, a first scale of said second set being on said first sliding member and having spaced apart indicia representative of camera lens filter f-difference, a second scale of said second set being on said first sliding member and having spaced apart indicia representative of said camera lens filter exposure factor (EF), a third scale of said second set being on said second sliding member and having spaced apart indicia representative of said fill-edge-light light-ratio (Rfe), a fourth scale of said second set being on said second sliding member and having spaced apart indicia representative of fill-light light-ratio (R), the index of said second set being on said second sliding member and being representative of a solitary-light, a fifth scale of said second set being on said second sliding member and having spaced apart indicia representative of said main-light light-ratio (R), a sixth scale of said second set being on said second sliding member and having spaced apart indicia representative of main-edge-light light-ratio (Rme);

a third set of cooperating scales positioned on adjacent portions of said second sliding member and said third sliding member, a first scale of said third set being on said second sliding member and having spaced apart indicia representative of said light power factor, a second scale of said third set being on said second sliding member and having spaced apart indicia representative of light filter exposure (EF), a third scale of said third set being on said third sliding member and having spaced apart indicia representative of working distance (WD);

a fourth set of cooperating scales and indexes positioned on adjacent portions of said third sliding member and said panel member, a first scale of said fourth set being on said third sliding member and being representative of solitary-light angle, a first index of said fourth set being on said third sliding member and being representative of said fill-light, a second index of said fourth set being on said third sliding member and being representative of said fill-edge-light, a third index of said fourth set being on said third sliding member and being representative of said main-edge-light, a fourth index of said fourth set being on said third sliding member and being representative of said main-light, a second scale of said fourth set being on said panel member and having spaced apart indicia representative of a solitary-light guide number at 100 ISO ($GN_{SL}$), a fifth index of said fourth set being on said panel member and being representative of a main-edge-light guide number at a selected ISO ($GN_{MEL}$), a sixth index of said fourth set being on said panel member and being representative of a fill-light guide number at a selected ISO ($GN_{FL}$), a third scale of said fourth set being on said panel member and having spaced apart indicia representative of main-light degrees ($\theta$) and positioned to be representative of said main-light guide number at a selected ISO ($GN_{ML}$), a fourth scale of said fourth set being on said panel member and having spaced apart indicia representative of said main-light light-ratio (R) and positioned to be representative of said fill-edge-light guide number at a selected ISO ($GN_{FEL}$), whereby;

said fill-edge-light working distance ($WD_{FEL}$) is calculated by sliding said first sliding member until a selected camera lens f-stop (fL) aligns with a selected film ISO ($ISO_{FILM}$), then sliding said second member until a selected camera lens filter exposure factor (EF) or a selected camera lens filter f-difference aligns with a selected fill-edge-light light-ratio (Rfe), then sliding said third sliding member until said second index (fill-edge-light) aligns with said selected main/-fill light-ratio (R) located on said panel member, finally said fill-edge-light working distance ($WD_{FEL}$) is read out opposite a selected fill-edge-light filter exposure factor (EF) or opposite a selected fill-edge-light power;

said fill-light working distance ($WD_{FL}$) is calculated by sliding said first sliding member until said selected camera lens f-stop ($f_L$) aligns with said selected film ISO ($ISO_{FILM}$), then sliding said second member until said camera lens filter exposure factor (EF) or said camera lens filter f-difference aligns with a selected fill-light light-ratio (R), then sliding said third sliding member until said first index (fill-light) aligns with said sixth index (fill-light), finally said fill-light working distance ($WD_{FL}$) is read out opposite a selected fill-light filter exposure factor (EF) or opposite a selected fill-light power;

said solitary-light working distance ($WD_{SL}$) is calculated by sliding said first sliding member until said selected camera lens f-stop ($f_L$) aligns with said selected film ISO ($ISO_{FILM}$), then sliding said second sliding member until said camera lens filter exposure factor (EF) or said camera lens filter f-difference aligns with said solitary-light index, then sliding said third sliding member until a selected solitary-light angle ($\theta$) located on said third sliding member aligns with a selected solitary-light guide number at 100 ISO ($GN_{SL}$), finally said solitary-light working distance ($WD_{SL}$) is read out opposite a selected solitary-light filter exposure factor (EF) or opposite a selected solitary-light power;

said main-light working distance ($WD_{ML}$) is calculated by sliding said first sliding member until said selected camera lens f-stop ($f_L$) aligns with said selected film ISO ($ISO_{FILM}$), then sliding said second sliding member until said camera lens filter exposure factor (EF) or said camera lens filter f-difference aligns with a selected main-light light-ratio (R), then sliding said third sliding member until said fourth index (main-light) aligns with a selected main-light degree ($\theta$), finally said main-light working distance ($WD_{ML}$) is read out opposite a selected main-light filter exposure factor (EF) or opposite a selected main-light power;

and said main-edge-light working distance ($WD_{MEL}$) is calculated by sliding said first sliding member until said selected camera lens f-stop ($f_L$) aligns with said selected film ISO ($ISO_{FILM}$), then sliding said second sliding member until said camera lens filter exposure factor (EF) or said camera lens filter f-difference aligns with a selected main-edge-light light-ratio (Rme), then sliding said third sliding member until said third index (main-edge-light) aligns with said fifth index (main-edge-light), finally said main-edge-light working distance ($WD_{MEL}$) is read out opposite a selected main-edge-light filter exposure factor (EF) or opposite a selected main-edge-light power.

2. A slide calculator as in claim 1, wherein said fifth index (main-edge-light) and said sixth index (fill-light) may be omitted from said panel member and wherein said first index, second index, third index, and fourth index may be omitted from said third sliding member, thus providing blank space where a user can make index marks and labels on said calculator representing guide numbers and indexes for particular lights such that when two or more of said lights have the same guide number, said indexes can be positioned to avoid more than one index occupying the same space.

3. A slide calculator as in claim 1, wherein the positioning of said scales relative to each other and the spacing of indicia within said scales representing said camera lens f-stop ($f_L$), film ISO ($ISO_{FILM}$), camera lens filter exposure factor (EF) or camera lens filter f-difference expressed as exposure factor (EF), of fill-edge-light light-ratio (Rfe), fill-edge-light filter exposure factor (EF), fill-edge-light power factor expressed as exposure factor (EF), fill-edge-light working distance ($WD_{FEL}$), fill-edge-light guide number ($GN_{FEL}$) and main/fill light-ratio (R) are determined by the expression $$WD_{FEL} = \frac{GN_{FEL} * [(ISO_{FILM})/(ISO_{GN} * EF)]^{(0.5)}}{\{[0.5^{[log(Rfe)/log(0.5)]} - 1] * f_L^2 * 0.5^{[log(R)/log(2)]}\}^{(0.5)}}$$

where EF represents a product of all selected exposure factors and $ISO_{GN}$ represents an ISO value on which said $GN_{FEL}$ rating is based.

4. A slide calculator as in claim 1, wherein the positioning of said scales relative to each other and the spacing of indicia within said scales representing said camera lens f-stop ($f_L$), film ISO ($ISO_{FILM}$), camera lens filter exposure factor (EF) or camera lens filter f-difference expressed as exposure factor (EF), main/fill light-ratio (R), fill-light filter exposure factor (EF), fill-light power factor expressed as exposure factor (EF), fill-light working distance ($WD_{FL}$) and fill-light guide number ($GN_{FL}$) are determined by the expression $$WD_{FL} = \frac{GN_{FL} * [(ISO_{FILM})/(ISO_{GN} * EF)]^{(0.5)}}{[f_L^2/R]^{(0.5)}}$$

where EF represents a product of all selected exposure factors and $ISO_{GN}$ represents an ISO value on which said $GN_{FL}$ rating is based.

5. A slide calculator as in claim 1, wherein the positioning of said scales relative to each other and the spacing of indicia within said scales representing said camera lens f-stop ($f_L$), film ISO ($ISO_{FILM}$), camera lens filter exposure factor (EF) or camera lens filter f-difference expressed as exposure factor (EF), solitary-light filter exposure factor (EF), solitary-light power factor expressed as exposure factor (EF), solitary-light working distance ($WD_{SL}$) and solitary-light guide number at 100 ISO ($GN_{SL}$) are determined by the expression $$WD_{SL} = \frac{GN_{SL} * (\cos\theta)^{(0.5)} * [(ISO_{FILM})/(ISO_{GN} * EF)]^{(0.5)}}{f_L}$$

where EF represents a product of all selected exposure factors and $ISO_{GN}$ represents an ISO value on which said $GN_{SL}$ rating is based.

6. A slide calculator as in claim 1, wherein the positioning of said scales relative to each other and the spacing of indicia within said scales representing said camera lens f-stop ($f_L$), film ISO ($ISO_{FILM}$), camera lens filter exposure factor (EF) or camera lens filter f-difference expressed as exposure factor (EF), main/fill light-ratio (R), main-light filter exposure factor (EF), main-light power factor expressed as exposure factor (EF), main-light working distance ($WD_{ML}$), main-light guide number ($GN_{ML}$) and main-light degrees ($\theta$) are determined by the expression $$WD_{ML} =$$

-continued $$\frac{GN_{ML} * (\cos(\theta/2))^{(0.5)} * [(ISO_{FILM})/(ISO_{GN} * EF)]^{(0.5)}}{\{f_L^2/[1 + (1/(R - 1))]\}^{(0.5)}}$$

where EF represents a product of all selected exposure factors and $ISO_{GN}$ represents an ISO value on which said $GN_{ML}$ rating is based.

7. A slide calculator as in claim 1, wherein the positioning of said scales relative to each other and the spacing of indicia within said scales representing said camera lens f-stop ($f_L$), film ISO ($ISO_{FILM}$), camera lens filter exposure factor (EF) or camera lens filter f-difference expressed as exposure factor (EF), main-edge-light light-ratio (Rme), main-edge-light filter exposure factor (EF), main-edge-light power factor expressed as exposure factor (EF), main-edge-light working distance ($WD_{MEL}$) and main-edge-light guide number ($GN_{MEL}$) are determined by the expression $$WD_{MEL} = \frac{GN_{MEL} * [(ISO_{FILM})/(ISO_{GN} * EF)]^{(0.5)}}{\{[f_L^2/2^{[log(Rme)/log(0.5)]}] - f_L^2\}^{(0.5)}}$$

where EF represents a product of all selected exposure factors and $ISO_{GN}$ represents an ISO value on which said $GN_{MEL}$ rating is based.

8. A slide calculator for providing accurately correct exposure of a subject, and accurate user selectable light-ratio (R) for said subject in direct sunlight by calculating the correct working distance ($WD_{SF}$) for a fill-in-light and accurate f-stop ($f_L$) for a camera lens comprising;

a panel member having a window-like aperture and first and second sliding members cooperatively associated with said panel member and movable with respect thereto and having;

a light-ratio-index positioned on said panel member adjacent to and cooperating with a graph positioned on said first sliding member, said graph having lines parallel to the adjacent edges of said panel member and said first sliding member and spaced apart so as to be representative of f-difference with a family of curves crossing said parallel lines (f-diff) and being spaced apart and curved so as to be representative of light-ratio (R) whereby the points of intersection of said parallel lines (f-diff) and said curves (R) are projected to cooperate with light-ratio-index;

a first set of cooperating scales positioned on adjacent portions of said panel member and said first sliding member, a first scale of said first set being on said panel member and having spaced apart indicia representative of a fraction of an f-stop to be added to sun f-stop ($f_{SUN}$) which will then be representative of camera lens f-stop ($f_L$), a second scale of said first set being on said first sliding member and having spaced apart indicia representative of said f-difference (f-diff);

a second set of cooperating scales positioned on adjacent portions of said first sliding member and said second sliding member, a first scale of said second set being on said first sliding member and having spaced apart indicia representative of said f-difference (f-diff) and a second scale of said second set being on said second sliding member and having spaced apart indicia representative of sun f-stop ($f_{SUN}$);

a third set of cooperating scales positioned on adjacent portions of said second sliding member and said panel member, a first scale of said third set being on said second sliding member and having spaced apart indicia representative of said working distance ($WD_{SF}$), a second scale of said third set being on said panel member and having spaced apart indicia representative of a guide number ($GN_{SF}$) at 100 ISO whereby;

said camera lens f-stop ($f_L$) is calculated by sliding said first slide member until a projected point of intersection of a selected f-difference and a selected light-ratio (R) aligns with said light-ratio-index, then read out a fraction of an f-stop on said panel member opposite a selected f-difference on said first sliding member, then determine said camera lens f-stop ($f_L$) by adding said fraction of an f-stop to said sun f-stop ($f_{SUN}$); and said working distance ($WD_{SF}$) is calculated by sliding said second sliding member until said sun f-stop ($f_{SUN}$) aligns with said f-difference, finally said working distance ($WD_{SF}$) is read out opposite a selected guide number (GN).

9. A slide calculator as in claim 8, wherein the positioning of said scales relative to each other and the spacing of indicia within said scales representing said light-ratio (R), camera lens f-stop ($f_L$), sun f-stop ($f_{SUN}$) and shade f-stop ($f_{SHADE}$) are determined by the expression $$f_L = \{[(f_{SUN2} - f_{SHADE2})/(R-1)] - (f_{SHADE})^2 + f_{SUN2}\}^{(0.5)}$$

and wherein the positioning of said scales relative to each other and the spacing of indicia within said scales representing said light-ratio (R), film ISO ($ISO_{FILM}$), sun f-stop ($f_{SUN}$), shade f-stop ($f_{SHADE}$), fill-in-light working distance ($WD_{SF}$) and fill-in-light guide number at 100 ISO ($ISO_{GN}$) are determined by the expression $$WD_{SF} = \frac{GN_{SF} * [(ISO_{FILM})/(ISO_{GN})]^{(0.5)}}{\{[(f^2_{SUN} - f^2_{SHADE})/(R-1)] - (f_{SHADE})^2\}^{(0.5)}}$$

where $ISO_{GN}$ represents an ISO value on which said $GN_{SF}$ rating is based.

10. A slide calculator for providing accurately correct exposure at the front of a subject and accurate user selectable front-to-rear light-ratio (Rfr) by calculating the working distance ($WD_{Rfr}$) of a light and a power factor required of said light, comprising;

a panel member having two window-like apertures and first, second, third sliding members, said sliding members being cooperatively associated with each other and said panel member and movable with respect to said panel member;

a first set of cooperating scales positioned on adjacent portions of said panel member and said first sliding member, a first scale of said first set being on said panel member and having spaced apart indicia representative of a lens f-stop ($f_L$), a second scale of said first set being on said first sliding member and having spaced apart indicia representative of film ISO ($ISO_{FILM}$);

a second set of cooperating scales positioned on adjacent portions of said first sliding member and said second sliding member, a first scale of said second set being on said first sliding member and having spaced apart indicia representative of said light working distance ($WD_{Rfr}$), a front-torear light-ratio index of said second set being on said first sliding member for alignment with a front-to-rear light-ratio (Rfr) scale, a second scale of said second set being on said second sliding member and having spaced apart indicia representative of subject depth ($D_{SUBJ}$), a third scale of said second set being on said second sliding member and having spaced apart indicia representative of said front-to-rear light-ratio (Rfr);

a third set of cooperating scales positioned on adjacent portions of said second sliding member and said third sliding member, a first scale of said third set being on said second sliding member and having spaced apart indicia representative of said subject depth ($D_{SUBJ}$), a second scale of said third set being on said third sliding member and having spaced apart indicia representative of a camera lens filter exposure factor (EF);

a fourth set of cooperating scales positioned on adjacent portions of said third sliding member and said panel member, a first scale of said fourth set being on said third sliding member and having spaced apart indicia representative of said power factor of said light, and a second scale of said fourth set being on said panel member and having spaced apart indicia representative of a light guide number at 100 ISO ($GN_{Rfr}$) whereby;

said working distance ($WD_{Rfr}$) is determined by sliding said first sliding member until said camera lens f-stop ($f_L$) aligns with said film ISO ($ISO_{FILM}$), then sliding said second sliding member until a selected front-to-rear light-ratio (Rfr) aligns with said front-to-rear light-ratio index, then read out a light working distance ($WD_{Rfr}$) opposite said subject depth ($D_{SUBJ}$);

and said power factor is determined by leaving said first and second sliding members fixed in said position used to determine working distance ($WD_{Rfr}$), then sliding said third sliding member until said camera lens filter exposure factor (EF) aligns with said subject depth ($D_{SUBJ}$) and, finally, reading out said power factor opposite a selected guide number ($GN_{Rfr}$).

11. A slide calculator as in claim 10, wherein the positioning of said scales relative to each other and the spacing of indicia within said scales representing said subject depth ($D_{SUBJ}$), front-to-rear light-ratio (Rfr), and light working distance ($WD_{Rfr}$) are determined by the expression $$WD_{Rfr} = \frac{D_{SUBJ}}{Rfr^{(0.5)} - 1}$$

and wherein the positioning of said scales relative to each other and the spacing of indicia within said scales representing said subject depth ($D_{SUBJ}$), film ISO ($ISO_{FILM}$), front-to-rear light-ratio (Rfr), camera lens f-stop (fL), camera lens filter exposure factor (EF), light guide number at 100 ISO ($GN_{Rfr}$) and said light power are determined by the expression $$\text{Power} = \frac{D^2_{SUBJ} * f_L^2 * EF}{GN^2_{Rfr} * [(ISO_{FILM})/(ISO_{GN})] * (Rfr^{(0.5)} - 1)^2}$$

where EF represents a product of all selected exposure factors and $ISO_{GN}$ represents an ISO value on which said $GN_{Rfr}$ rating is based.

12. A method for determining an index location on a slide calculator, said index being representative of a specific fill-edge-light whereby said slide calculator provides accurately correct exposure of a subject and accurate user selectable fill-edge-light light-ratio by calculating a correct working distance for said fill-edge-light;

said calculator comprising a panel member having two window-like apertures and first, second and third sliding members, said sliding members being cooperatively associated with each other and said panel member, and movable with respect to said panel member and having;

a first set of cooperating scales positioned on adjacent portions of said panel member and said first sliding member, a first scale of said first set being on said panel member and having spaced apart indicia representative of camera lens f-stop ($f_L$), a second scale of said first set being on said first sliding member and having spaced apart indicia representative of film ISO ($ISO_{FILM}$);

a second set of cooperating scales and an index positioned on adjacent portions of said first sliding member and said second sliding member, a first scale of said second set being on said first sliding member and having spaced apart indicia representative of camera lens filter f-difference, a second scale of said second set being on said first sliding member and having spaced apart indicia representative of camera lens filter exposure factor (EF), a third scale of said second set being on said second sliding member and having spaced apart indicia representative of fill-edge-light light-ratio (Rfe), a fourth scale of said second set being on said second sliding member and having spaced apart indicia representative of fill-light light-ratio (R), an index of said second set being on said second sliding member and being representative of a solitary-light, a fifth scale of said second set being on said second sliding member and having spaced apart indicia representative of main-light light-ratio (R), a sixth scale of said second set being on said second sliding member and having spaced apart indicia representative of main-edge-light light-ratio (Rme);

a third set of cooperating scales positioned on adjacent portions of said second sliding member and said third sliding member, a first scale of said third set being on said second sliding member and having spaced apart indicia representative of light power factor, a second scale of said third set being on said second sliding member and having spaced apart indicia representative of light filter exposure factor (EF), a third scale of said third set being on said third sliding member and having spaced apart indicia representative of working distance (WD);

a fourth set of cooperating scales and indexes positioned on adjacent portions of said third sliding member and said panel member, a first scale of said fourth set being on said third sliding member and being representative of solitary-light angle, a first index of said fourth set being on said third sliding member and being representative of said fill-light, a second index of said fourth set being on said third sliding member and being representative of said fill-edge-light, a third index of said fourth set being on said third sliding member and being representative of said main-edge-light, a fourth index of said fourth set being on said third sliding member and being representative of said main-light, a second scale of said fourth set being on said panel member and having spaced apart indicia representative of a solitary-light guide number at 100 ISO ($GN_{SL}$), a fifth index of said fourth set being on said panel member and being representative of a main-edge-light guide number at a selected ISO ($GN_{MEL}$), a sixth index of said fourth set being on said panel member and being representative of a fill-light guide number at a selected ISO ($GN_{FL}$), a third scale of said fourth set being on said panel member and having spaced apart indicia representative of main-light degrees ($\theta$) positioned to be representative of said main-light guide number at a selected ISO ($GN_{ML}$), a fourth scale of said fourth set being on said panel member and having spaced apart indicia representative of said main-light light-ratio (R) and positioned to be representative of said fill-edge-light guide number at a selected ISO ($GN_{FEL}$);

said method comprising the following steps: choosing a specific Film ISO at which to test said fill-edge-light;

then determining the guide number of said fill-edge-light by testing said fill-edge-light at an angle at which it will be operating so that a cosine correction will be inherent in said guide number thus determined;

then choosing a first f-stop and dividing said guide number by a second f-stop which is one f-stop larger aperture than said first f-stop thus determining a working distance;

then moving said first sliding member until said selected film ISO aligns with said first f-stop on adjacent said f-stop scale;

then moving said second sliding member until a light-ratio of 2 on said fill-edge-light light-ratio scale aligns with 0f (zero f) on adjacent said f-difference scale;

then moving said third sliding member until said working distance aligns with a power of 1 on adjacent said power scale;

then putting a point of a marking device on a line representative of 2 on said main/fill light-ratio scale located on said panel member;

then marking adjacent said third sliding member such that said mark aligns with, and is adjacent said line;

then labeling said mark with "FILL-EDGE-LIGHT".

13. A method for determining two index locations on a slide calculator, one of said indexes being representative of a specific fill-light and the other of said indexes being representative of said fill-light guide number whereby said slide calculator provides accurately correct exposure of a subject and accurate user selectable fill-light light-ratio by calculating a correct working distance for said fill-light;

said calculator comprising a panel member having two window-like apertures and first, second and third sliding members, said sliding members being cooperatively associated with each other and said panel member, and movable with respect to said panel member and having;

a first set of cooperating scales positioned on adjacent portions of said panel member and said first sliding member, a first scale of said first set being on said panel member and having spaced apart indicia representative of camera lens f-stop ($f_L$), a second scale of said first set being on said first sliding member and having spaced apart indicia representative of film ISO ($ISO_{FILM}$);

a second set of cooperating scales and an index positioned on adjacent portions of said first sliding member and said second sliding member, a first scale of said second set being on said first sliding member and having spaced apart indicia representative of camera lens filter f-difference, a second scale of said second set being on said first sliding member and having spaced apart indicia representative of camera lens filter exposure factor (EF), a third scale of said second set being on said second sliding member and having spaced apart indicia representative of fill-edge-light light-ratio (Rfe), a fourth scale of said second set being on said second sliding member and having spaced apart indicia representative of fill-light light-ratio (R), an index of said second set being on said second sliding member and being representative of a solitary-light, a fifth scale of said second set being on said second sliding member and having spaced apart indicia representative of main-light light-ratio (R), a sixth scale of said second set being on said second sliding member and having spaced apart indicia representative of main-edge-light light-ratio (Rme);

a third set of cooperating scales positioned on adjacent portions of said second sliding member and said third sliding member, a first scale of said third set being on said second sliding member and having spaced apart indicia representative of light power factor, a second scale of said third set being on said second sliding member and having spaced apart indicia representative of light filter exposure factor (EF), a third scale of said third set being on said third sliding member and having spaced apart indicia representative of working distance (WD);

a fourth set of cooperating scales and indexes positioned on adjacent portions of said third sliding member and said panel member, a first scale of said fourth set being on said third sliding member and being representative of solitary-light angle, a first index of said fourth set being on said third sliding member and being representative of said fill-light, a second index of said fourth set being on said third sliding member and being representative of said fill-edge-light, a third index of said fourth set being on said third sliding member and being representative of said main-edge-light, a fourth index of said fourth set being on said third sliding member and being representative of said main-light, a second scale of said fourth set being on said panel member and having spaced apart indicia representative of a solitary-light guide number at 100 ISO ($GN_{SL}$), a fifth index of said fourth set being on said panel member and being representative of a main-edge-light guide number at a selected ISO ($GN_{MEL}$), a sixth index of said fourth set being on said panel member and being representative of a fill-light guide number at a selected ISO ($GN_{FL}$), a third scale of said fourth set being on said panel member and having spaced apart indicia representative of main-light degrees ($\theta$) and positioned to be representative of said main-light guide number at a selected ISO ($GN_{ML}$), a fourth scale of said fourth set being on said panel member and having spaced apart indicia representative of said main-light light-ratio (R) and positioned to be representative of said fill-edge-light guide number at a selected ISO ($GN_{FEL}$);

said method comprising the following steps: choosing a specific Film ISO at which to test said fill-light;

then determining the guide number of said fill-light by testing said fill-light at zero degrees angle so that no cosine correction will be inherent in said guide number thus determined;

then choosing a first f-stop and dividing said guide number by a second f-stop which is one f-stop larger aperture than said first f-stop thus determining a working distance;

then moving said first sliding member until said selected film ISO aligns with said first f-stop on said adjacent lens f-stop scale;

then moving said second sliding member until a light-ratio of 2 on said fill-light light-ratio scale aligns with 0f (zero f) on adjacent said f-difference scale;

then moving said third sliding member until said working distance aligns with a power of 1 on adjacent said second sliding member;

then drawing a line which crosses adjacent edges of said third sliding member and said panel whereby the line is divided into two separate lines on said third sliding member and panel member that can be misaligned and realigned by sliding said third sliding member;

then labeling each of said lines with "FILL-LIGHT".

14. A method for determining an index location, on a slide calculator, said index being representative of a specific main-light whereby said calculator provides accurately correct exposure of a subject and accurate user selectable main-light light-ratio by calculating a correct working distance for said main-light;

said calculator comprising a panel member having two window-like apertures and first, second and third sliding members, said sliding members being cooperatively associated with each other and said panel member, and movable with respect to said panel member;

a first set of cooperating scales positioned on adjacent portions of said panel member and said first sliding member, a first scale of said first set being on said panel member and having spaced apart indicia representative of camera lens f-stop ($f_L$), a second scale of said first set being on said first sliding member and having spaced apart indicia representative of film ISO ($ISO_{FILM}$);

a second set of cooperating scales and an index positioned on adjacent portions of said first sliding member and said second sliding member, a first scale of said second set being on said first sliding member and having spaced apart indicia representative of camera lens filter f-difference, a second scale of said second set being on said first sliding member and having spaced apart indicia representative of camera lens filter exposure factor (EF), a third scale of said second set being on said second sliding member and having spaced apart indicia representative of fill-edge-light light-ratio (Rfe), a fourth scale of said second set being on said second sliding member and having spaced apart indicia representative of fill-light light-ratio (R), an index of said second set being on said second sliding member and being representative of a solitary-light, a fifth scale of said second set being on said second sliding member and having spaced apart indicia representative of main-light light-ratio (R), a sixth scale of said second set being on said second sliding member and having spaced apart indicia representative of main-edge-light light-ratio (Rme);

a third set of cooperating scales positioned on adjacent portions of said second sliding member and said third sliding member, a first scale of said third set being on said second sliding member and having spaced apart indicia representative of light power factor, a second scale of said third set being on said second sliding member and having spaced apart indicia representative of light filter exposure factor (EF), a third scale of said third set being on said third sliding member and having spaced apart indicia representative of working distance (WD);

a fourth set of cooperating scales and indexes positioned on adjacent portions of said third sliding member and said panel member, a first scale of said fourth set being on said third sliding member and being representative of solitary-light angle, a first index of said fourth set being on said third sliding member and being representative of said fill-light, a second index of said fourth set being on said third sliding member and being representative of said fill-edge-light, a third index of said fourth set being on said third sliding member and being representative of said main-edge-light, a fourth index of said fourth set being on said third sliding member and being representative of said main-light, a second scale of said fourth set being on said panel member and having spaced apart indicia representative of a solitary-light guide number at 100 ISO ($GN_{SL}$), a fifth index of said fourth set being on said panel member and being representative of a main-edge-light guide number at a selected ISO ($GN_{MEL}$), a sixth index of said fourth set being on said panel member and being representative of a fill-light guide number at a selected ISO ($GN_{FL}$), a third scale of said fourth set being on said panel member and having spaced apart indicia representative of main-light degrees ($\theta$) and positioned to be representative of said main-light guide number at a selected ISO ($GN_{ML}$), a fourth scale of said fourth set being on said panel member and having spaced apart indicia representative of said main-light light-ratio (R) and positioned to be representative of said fill-edge-light guide number at a selected ISO ($GN_{FEL}$);

said method comprising the following steps: choosing a specific Film ISO at which to test said main-light; then determining the guide number of said main-light by testing said main-light at zero degree angle so that no cosine correction will be inherent in said guide number thus determined;

then choosing a first f-stop and dividing said guide number by a second f-stop which is one f-stop larger aperture than said first f-stop thus determining a working distance;

then moving said first sliding member until said selected film ISO aligns with said first f-stop on adjacent said lens f-stop scale;

then moving said second sliding member until a light-ratio of 2 on said main-light light-ratio scale aligns with 0f (zero f) on adjacent said f-difference scale;

then moving said third sliding member until said working distance aligns with a power of 1 on adjacent said second sliding member;

then putting a point of a marking device, on a line representing zero degrees on said main-light degrees scale;

then making a mark adjacent said third sliding member such that said mark aligns with, and is adjacent with zero degrees;

then labeling said mark with "MAIN-LIGHT".

15. A method for determining two index locations on a slide calculator, one of said indexes being representative of a specific main-edge-light and the other of said indexes being representative of said main-edge-light guide number whereby said slide calculator provides accurately correct exposure of a subject and accurate user selectable main-edge-light light-ratio by calculating a correct working distance for said main-edge-light;

said calculator comprising a panel member having two window-like apertures and first, second and third sliding members, said sliding members being cooperatively associated with each other and said panel member, and movable with respect to said panel member;

a first set of cooperating scales positioned on adjacent portions of said panel member and said first sliding member, a first scale of said first set being on said panel member and having spaced apart indicia representative of camera lens f-stop ($f_L$), a second scale of said first set being on said first sliding member and having spaced apart indicia representative of film ISO ($ISO_{FILM}$);

a second set of cooperating scales and an index positioned on adjacent portions of said first sliding member and said second sliding member, a first scale of said second set being on said first sliding member and having spaced apart indicia representative of camera lens filter f-difference, a second scale of said second set being on said first sliding member and having spaced apart indicia representative of camera lens filter exposure factor (EF), a third scale of said second set being on said second sliding member and having spaced apart indicia representative of fill-edge-light light-ratio (Rfe), a fourth scale of said second set being on said second sliding member and having spaced apart indicia representative of fill-light light-ratio (R), an index of said second set being on said second sliding member and being representative of a solitary-light, a fifth scale of said second set being on said second sliding member and having spaced apart indicia representative of main-light light-ratio (R), a sixth scale of said second set being on said second sliding member and having spaced apart indicia representative of main-edge-light light-ratio (Rme);

a third set of coorperating scales positioned on adjacent portions of said second sliding member and said third sliding member, a first scale of said third set being on said second sliding member and having spaced apart indicia representative of light power factor, a second scale of said third set being on said second sliding member and having spaced apart indicia representative of light filter exposure (EF), a third scale of said third set being on said third sliding member and having spaced apart indicia representative of working distance (WD);

a fourth set of cooperating scales and indexes positioned on adjacent portions of said third sliding member and said panel member, a first scale of said fourth set being on said third sliding member and being representative of solitary-light angle, a first index of said fourth set being on said third sliding member and being representative of said fill-light, a second index of said fourth set being on said third sliding member and being representative of said fill-edge-light, a third index of said fourth set being on said third sliding member and being representative of said main-edge-light, a fourth index of said fourth set being on said third sliding member and being representative of said main-light, a second scale of said fourth set being on said panel member and having spaced apart indicia representative of a solitary-light guide number at 100 ISO ($GN_{SL}$), a fifth index of said fourth set being on said panel member and being representative of said main-edge-light guide number at a selected ISO ($GN_{MEL}$), a sixth index of said fourth set being on said panel member and being representative of a fill-light guide number at a selected ISO ($GN_{FL}$), a third scale of said fourth set being on said panel member and having spaced apart indicia representative of a main-light degrees ($\theta$) and positioned to be representative of said main-light guide number at a selected ISO ($GN_{ML}$), a fourth scale of said fourth set being on said panel member and having spaced apart indicia representative of said main-light light-ratio (R) and positioned to be representative of said fill-edge-light guide number at a selected ISO ($GN_{FEL}$);

said method comprising the following steps: choosing a specific Film ISO at which to test said main-edge-light;

then determining the guide number of said main-edge-light by testing said main-edge-light at an angle at which it will be operating so that a cosine correction will be inherent in said guide number thus determined;

then choosing a first f-stop and dividing said guide number by a second f-stop which is one f-stop larger aperture than said first f-stop thus determining a working distance;

then moving said first sliding member until said selected film ISO aligns with said first f-stop on said adjacent lens f-stop scale;

then moving said second sliding member until a light-ratio of 1.5 on said main-edge-light light-ratio scale aligns with 0f (zero f) on adjacent said f-difference scale;

then moving said third sliding member until said working distance aligns with a power of 1 on adjacent said second sliding member;

then drawing a line which crosses adjacent edges of said third sliding member and said panel whereby the line is divided into two separate lines on said third sliding member and panel member that can be misaligned and realigned by sliding said third sliding member;

then labeling each of said lines with "MAIN-EDGE-LIGHT".

* * * * *